US011778699B2

(12) United States Patent
Tsurusawa et al.

(10) Patent No.: US 11,778,699 B2
(45) Date of Patent: Oct. 3, 2023

(54) HEATER

(71) Applicant: NITTO DENKO CORPORATION, Ibaraki (JP)

(72) Inventors: Toshihiro Tsurusawa, Osaka (JP); Takeshi Tanaka, Osaka (JP); Yosuke Nakanishi, Osaka (JP); Kyotaro Yamada, Osaka (JP); Hironobu Machinaga, Osaka (JP)

(73) Assignee: NITTO DENKO CORPORATION, Ibaraki (JP)

( * ) Notice: Subject to any disclaimer, the term of this patent is extended or adjusted under 35 U.S.C. 154(b) by 638 days.

(21) Appl. No.: 16/634,941

(22) PCT Filed: Aug. 3, 2018

(86) PCT No.: PCT/JP2018/029293
§ 371 (c)(1),
(2) Date: Jan. 29, 2020

(87) PCT Pub. No.: WO2019/027049
PCT Pub. Date: Feb. 7, 2019

(65) Prior Publication Data

US 2020/0214089 A1 Jul. 2, 2020

(30) Foreign Application Priority Data

Aug. 4, 2017 (JP) ..... 2017-152002
Aug. 2, 2018 (JP) ..... 2018-145550

(51) Int. Cl.
*H05B 3/28* (2006.01)
*H05B 3/03* (2006.01)
*H05B 3/14* (2006.01)

(52) U.S. Cl.
CPC ..... *H05B 3/286* (2013.01); *H05B 3/03* (2013.01); *H05B 3/141* (2013.01); *H05B 2203/013* (2013.01); *H05B 2203/032* (2013.01)

(58) Field of Classification Search
CPC ..... H05B 2203/017; H05B 2203/011; H05B 2203/013; H05B 3/84; H05B 3/86;
(Continued)

(56) References Cited

U.S. PATENT DOCUMENTS 5,911,899 A * 6/1999 Yoshikai ..... H05B 3/86 219/522
7,042,612 B2 * 5/2006 Lazarev ..... G02F 1/035 359/248
(Continued)

FOREIGN PATENT DOCUMENTS

EP 487338 A1 5/1992
EP 0749266 A2 12/1996
(Continued)

OTHER PUBLICATIONS

English translation of JPH0963754A (Year: 1997).*
(Continued)

*Primary Examiner* — Chris Q Liu
(74) *Attorney, Agent, or Firm* — WHDA, LLP

(57) ABSTRACT

A heater (1*a*) includes a support (10) made of an organic polymer and having a sheet shape, a heating element (20), and at least one pair of power supply electrodes (30) in contact with the heating element (20). The heating element (20) is a transparent conductive film made of a polycrystalline material containing indium oxide as a main component. In the heater (1*a*), the heating element (20) has a specific resistance of $1.4\times10^{-4}$ Ω·cm to $3\times10^{-4}$ Ω·cm. The heating element (20) has a thickness of more than 20 nm and not more than 100 nm.

11 Claims, 4 Drawing Sheets

(58) Field of Classification Search
CPC ..... H05B 2203/007; H05B 2203/01; H05B 2203/014; H05B 2203/033; H05B 2203/037; H05B 3/06; H05B 3/146; H05B 3/20; H05B 3/36; H05B 3/56
USPC ..... 219/203, 451.1, 468.1, 522, 539, 548; 428/336; 252/500
See application file for complete search history.

(56) References Cited

U.S. PATENT DOCUMENTS

| | | | | |
|---|---|---|---|---|
| 7,211,824 | B2 * | 5/2007 | Lazarev | H10K 10/26 257/40 |
| 2015/0086789 | A1 * | 3/2015 | Kajihara | H05K 1/09 428/480 |
| 2015/0102023 | A1 | 4/2015 | Mitsuhashi | |
| 2016/0024640 | A1 * | 1/2016 | Sasa | C23C 14/5806 428/336 |
| 2017/0186778 | A1 * | 6/2017 | Miyake | H01L 29/7786 |

FOREIGN PATENT DOCUMENTS

| | | | |
|---|---|---|---|
| JP | 61-175068 | U | 10/1986 |
| JP | 63-115048 | U | 7/1988 |
| JP | H03-107123 | A | 5/1991 |
| JP | 6-283260 | A | 10/1994 |
| JP | 9-63754 | A | 3/1997 |
| JP | 9-125236 | A | 5/1997 |
| JP | 2002-134254 | A | 5/2002 |
| JP | 2004-12846 | A | 1/2004 |
| JP | 2007-220636 | A | 8/2007 |
| JP | 2016-46237 | A | 4/2016 |
| JP | 2017-91858 | A | 5/2017 |

OTHER PUBLICATIONS

English translation of JP2017091858A (Year: 2017).*
International Search Report dated Oct. 16, 2018, issued in counterpart International Application No. PCT/JP2018/029293 (1 page).
International Search Report dated Oct. 16, 2018, issued in International Application No. PCT/JP2018/029292 (Counterpart to U.S. Appl. No. 16/636,149) (2 pages).
Extended (Supplementary) European Search Report dated May 14, 2021, issued in U.S. Appl. No. 16/636,149 (Counterpart to U.S. Appl. No. 16/636,149)(8 pages).
Non-Final Action dated Mar. 31, 2022, issued in U.S. Appl. No. 16/636,149 (17 pages).
Extended (Supplementary) European Search Report dated Mar. 25, 2021, issued in counterpart EP Application No. 18841328.0. (9 pages).

* cited by examiner

HEATER

TECHNICAL FIELD

The present invention relates to a heater.

BACKGROUND ART

Conventionally, planar heaters are known that includes a heating element, which is a thin film containing indium tin oxide (ITO).

For example, Patent Literature 1 discloses a heat glass that includes a thin-film ITO heating element formed on a glass substrate by sintering a paste containing indium tin oxide (ITO) as a main component. The ITO heating element is formed by screen-printing the ITO-containing paste, which is prepared by mixing spherical ITO particles having a predetermined average particle diameter with a solvent and a resin, on the glass substrate and sintering the ITO-containing paste. For example, the ITO-containing paste is sintered at 480° C. for 30 minutes. Patent Literature 1 describes that the thus-formed ITO heating element has a low resistivity and a high transmittance.

Patent Literature 2 proposes a transparent planar heater configured such that a laminate of thin films made of indium oxide, Ag, and indium oxide, respectively, is formed on a transparent organic polymer film such as a polyethylene terephthalate (PET) film by DC magnetron sputtering.

CITATION LIST

Patent Literatures

Patent Literature 1: JP 2016-46237 A
Patent Literature 2: JP 6(1994)-283260 A

SUMMARY OF INVENTION

Technical Problem

According to Patent Literature 1, the ITO heating element formed by sintering the ITO-containing paste has a low resistivity from 0.0001 Ω·cm to 20 Ω·cm and exhibits a high transmittance in a wavelength range from 400 to 1500 nm. On the other hand, in the technique described in Patent Literature 1, a glass substrate or the like is required to withstand the sintering of the ITO-containing paste. Accordingly, the technique disclosed in Patent Literature 1 does not envisage forming a heating element, which is a transparent conductive film made of ITO or the like, on a sheet-shaped support made of an organic polymer, and roll-to-roll production is thus not applicable to the heat glass disclosed in Patent Literature 1. In addition, the heat glass disclosed in Patent Literature 1 cannot be set in or bonded to a curved portion easily.

In the transparent planar heater disclosed in Patent Literature 2, the organic polymer film is used as the substrate, and roll-to-roll production is thus applicable to the transparent planar heater. In addition, it is considered that the transparent surface heater of Patent Literature 2 can be set in or bonded to a curved portion easily. However, it is generally considered that a laminate including an Ag thin film is hard to handle during production and installation because the Ag thin film becomes more susceptible to corrosion owing to abrasion formed on the thin film. Patent Literature 2 also proposes a transparent planar heater configured such that an ITO film is formed on a transparent organic polymer film such as a polyethylene terephthalate (PET) film by DC magnetron sputtering. This transparent planar heater can prevent corrosion caused by abrasion formed on a thin film. However, the ITO film has a very large thickness of 400 nm owing to a high resistivity of ITO. Accordingly, the ITO film may crack easily owing to bending deformation of the film during the production or installation.

As described above, according to Patent Literature 1, although the ITO heating element haring a low specific resistance and a high transparency can be formed on the glass substrate by sintering the ITO-containing paste, the glass substrate or the like is required to withstand the sintering of the ITO-containing paste. Thus, it is not possible to form the heating element, which is a transparent conductive film made of ITO or the like, on a film-shaped support made of an organic polymer. On the other hand, Patent Literature 2 proposes a transparent, planar heater configured such that a transparent organic polymer film is used as a substrate, and a laminate of thin films made of indium oxide, Ag, and indium oxide, respectively, or an ITO thin film having a thickness of 400 nm is formed on the substrate by DC magnetron sputtering. However, according to the technique disclosed in Patent Literature 2, cracking may occur easily owing to corrosion caused by abrasion or bending during production or installation.

In light of the foregoing, it is an object of the present invention to provide a heater in which a heating element formed on a sheet-shaped support made of an organic polymer is highly resistant to abrasion or bending.

Solution to Problem

The present invention provides a heater including: a support that is made of an organic polymer and has a sheet shape; a heating element that is a transparent conductive film made of a polycrystalline material containing indium oxide as a main component; and at least one pair of power supply electrodes in contact with the heating element, wherein the heating element has a thickness of more than 20 nm and not more than 100 nm, and the heating element has a specific resistance of $1.4\times10^{-4}$ Ω·cm to $3\times10^{-4}$ Ω·cm.

Advantageous Effects of Invention

Although the heater described above is configured such that the heating element is formed on the sheet-shaped support made of an organic polymer, the heating element is highly resistant to abrasion or bending during production or installation.

DESCRIPTION OF EMBODIMENTS

Hereinafter, embodiments of the present invention will be described with reference to the drawings. The following embodiments describe merely illustrative implementation of the present invention, and the present invention is not limited to the following embodiments.

Figure 1:
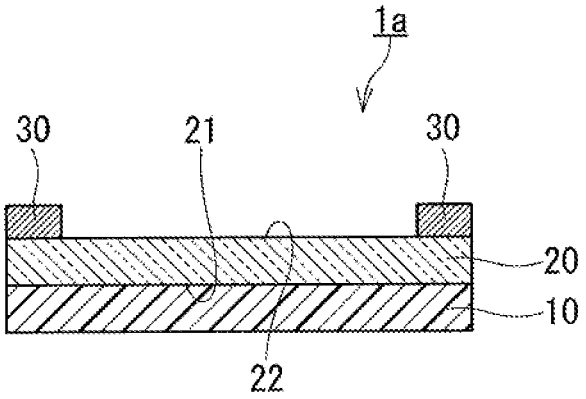
FIG. 1 is a cross-sectional view showing an example of the heater of the present invention.

As shown in FIG. 1, a heater 1*a* includes a support 10, a heating element 20, and at least one pair of power supply electrodes 30. The support 10 is made of an organic polymer and has a sheet shape. The heating element 20 is a transparent conductive film made of a polycrystalline material containing indium oxide as a main component. The term "main component" as used herein refers to a component whose content on a mass basis is the highest. The at least one pair of power supply electrodes 30 are in contact with the heating element 20. The heating element has a specific resistance of $1.4\times10^{-4}$ Ω·cm to $3\times10^{-4}$ Ω·cm. The heating element 20 has a thickness of more than 20 nm and not more than 100 nm. The heater 1*a* is typically a planar heater.

The heating element 20 is in contact with the sheet-shaped support 10 made of an organic polymer. Since the heating element 20 has a small thickness of more than 20 nm and not more than 100 nm, the heating element 20 is less likely to crack even when the support 10 is bent. The heating element also has a low specific resistance of $1.4\times10^{-4}$ Ω·cm to $3\times10^{-4}$ Ω·cm. Accordingly, while the heating element 20 has such a small thickness, the sheet resistance of the heating element 20 is low, and this allows the heater 1*a* to exhibit desired heating performance.

The specific resistance of the heating element 20 is desirably $1.4\times10^{-4}$ Ω·cm to $2.7\times10^{-4}$ Ω·cm, and more desirably $1.4\times10^{-4}$ Ω·cm to $2.5\times10^{-4}$ Ω·cm.

The heating element 20, for example, has a carrier density of $6\times10^{20}$ $cm^{-3}$ to $16\times10^{20}$ $cm^{-3}$. This configuration more reliably allows the heating element 20 to have a low specific resistance, and thus allows the heating element 20 to have a low sheet resistance even if the heating element 20 is thin. The carrier density of the heating element 20 is determined by Hall effect measurement. The Hall effect measurement is performed according to the van der Pauw method, for example. The carrier density of the heating element 2 is desirably $7\times10^{20}$ $cm^{-3}$ to $16\times10^{20}$ $cm^{-3}$, and more desirably $8\times10^{20}$ $cm^{-3}$ to $16\times10^{20}$ $cm^{-3}$.

For example, the ratio of the number of tin atoms to the sum of the number of indium atoms and the number of the tin atoms in the heating element 20 is 0.04 to 0.15. This configuration more reliably allows the heating element 20 to have a low specific resistance, and thus allows the heating element 20 to have a low sheet resistance even if the heating element 20 is thin.

For example, the crystal grains of the heating element 20 have an average size of 150 nm to 500 nm, assuming that the size of each crystal grain is the diameter of a perfect circle having the area equal to the projected area of each crystal grain in a specific direction. This configuration more reliably allows the heating element 20 to have a low specific resistance, and thus allows the heating element 20 to have a low sheet resistance even if the heating element 20 is thin. The crystal grains of the heating element 20 desirably have an average size of 180 nm to 500 nm, and more desirably an average size of 200 nm to 500 nm. The crystal grains of the heating element 20 can be determined in a manner described in examples of the present invention, for example.

The concentration of argon atoms contained in the heating element 20 is, for example, 3.5 ppm (parts per million) or less on a mass basis. This configuration more reliably allows the heating element 20 to have a low specific resistance, and thus allows the heating element 20 to have a low sheet resistance even if the heating element 20 is thin. The concentration of argon atoms contained in the heating element 20 is desirably 3.5 ppm or less on a mass basis, and more desirably 2.7 ppm or less on a mass basis.

The internal stress of the hearing element 20 as measured by an X-ray stress measurement method is, for example, 20 to 650 MPa. This configuration allows the heating element 20 to be still less likely to crack. The internal stress of the heating element 20 can be measured in a manner described in examples of the present invention according to the X-ray stress measurement method. The internal stress of the heating element 20 may be 50 to 650 MPa, or may be 100 to 650 MPa.

The transparent conductive film, which is used as the heating element 20, is not particularly limited. For example, the transparent conductive film is obtained by performing sputtering using a target material containing indium oxide as a main component to form a thin film derived from the target material on one principal surface of the support 10. The thin film derived horn the target material is desirably formed on one principal surface of the support 10 by high magnetic field DC magnetron sputtering. In this case, the heating element 20 can be formed at a lower temperature as compared with the case where the heating element 20 is formed by screen-printing an ITO-containing paste on a glass substrate and then sintering the ITO-containing paste. This allows the heating element 20 to be formed on the sheet-shaped support 10 made of an organic polymer. In addition, defects are less likely to be formed in the transparent conductive film. Accordingly, a larger amount of carriers can be generated, and also, a low internal stress of the heating element 20 can be achieved more easily.

The thin film formed on one principal surface of the support 10 is subjected to annealing, when necessary. For example, the thin film is annealed by being placed in the air at 120° C. to 150° C. for 1 to 3 hours. This facilitates crystallization of the thin film, whereby the transparent conductive film made of a polycrystalline material is formed advantageously. When the temperature of the environment in which the annealing of the thin film is performed and the time period for performing the annealing are within the above-described ranges, the sheet-shaped support made of an organic polymer can be used as the support 10 of the heating element 20 without problems. In addition, defects are less like to be formed in the transparent conductive film, and a low internal stress of the heating element 20 can be achieved more easily.

In the heater 1*a*, the material of the support 10 is not particularly limited. It is desirable that the support 10 be made of at least one selected from the group consisting of polyethylene terephthalates, polyethylene naphthalates, polyimides, polycarbonates, polyolefins, polyether ether ketones, and aromatic polyamides. With this configuration, the heater 1*a* has transparency and bends easily.

The thickness of the support 10 is not limited to a particular thickness. From the viewpoint of favorable transparency, favorable strength, and ease of handling, the thickness of the support 10 is 10 μm to 200 μm, for example. The thickness of the support 10 may be 20 μm to 180 μm, or may be 30 μm to 160 μm.

The support 10 may include a functional layer such as a hard coat layer, a stress buffer layer, or an optical adjustment layer. Each of these functional layers constitutes, for example, one principal surface of the support 10 in contact with the heating element 20. Each of these functional layers can serve as a base of the heating element 20.

As shown in FIG. 1, the pair of power supply electrodes 30 are formed in contact with a second principal surface 22 of the heating element 20, for example. The second principal surface 22 is a principal surface located on the side opposite to the first principal surface 21 of the heating element 20 in contact with the support 10. The power supply electrodes 30 have a thickness of 1 μm or more, for example. In this case, the current-carrying capacity of the power supply electrodes 30 is easily adjusted to a value suitable for operating the heater 1*a* at a high temperature rise rate. Accordingly, when the heater 1*a* is operated at a high temperature rise rate, the power supply electrodes 30 are less likely to be damaged. The power supply electrodes 30 are much thicker than electrodes formed on a transparent conductive film used in display devices such as a touch panel. The power supply electrodes 30 desirably have a thickness of 1.5 μm or more, and more desirably 2 μm or more. The thickness of the power supply electrodes 30 is, for example, 5 mm or less, and may be 1 mm or less or 700 μm or less.

The pair of power supply electrodes 30 are not particularly limited as long as they can supply power from a power source (not shown) to the heating element 20. For example, the pair of power supply electrodes 30 are made of a metal material. A masking film is placed so as to partially cover the second principal surface 22 of the heating element 20. When another film is laminated on the second principal surface 22 of the heating element 20, the masking film may be placed on this film. In this state, a metal film with a thickness of 1 μm or more is formed on exposed portions of the heating element 20 and the marking film by a dry process such as chemical vapor deposition (CVD) or physical vapor deposition (PVD) or by a wet process such as plating. Thereafter, by removing the masking film, portions of the metal film remain in the exposed portions of the heating element 20, whereby the pair of power supply electrodes 30 can be formed. Alternatively, the pair of power supply electrodes 30 may be formed by forming a metal film with a thickness of 1 μm or more on the second principal surface 22 of the heating element 20 by a dry process such as CVD or PVD or by a wet process such as plating and then removing unnecessary portions of the metal film by etching.

The pair of power supply electrodes 30 may be formed using a conductive paste. In this case, the pair of power supply electrodes 30 can be formed by applying a conductive paste to the heating element 20, which is a transparent conductive film, according to a method such as screen printing.

For example, in an apparatus configured to execute processing using near-infrared light within a wavelength range from 780 to 1500 nm, the heater 1*a* is to be disposed on the optical path of t his near-infrared light. This apparatus execute predetermined processing such as sensing or communication using the near-infrared light within the wavelength range from 780 to 1500 nm, for example. On this account, the heater 1*a* has high transparency to the near-infrared light within the wavelength range from 780 to 1500 nm, for example.

(Modifications)

The heater 1*a* can be modified in various respects. For example, the heater 1*a* may be modified so as to have the configuration of any of heaters 1*b* to 1*f* shown in FIGS. 2 to 6, respectively. Unless otherwise stated, the configurations of the heaters 1*b* to 1*f* are the same as the configuration of the heater 1*a*. Components of the heaters 1*b* to 1*f* that are the same as or correspond to those of the heater 1*a* are given the same reference numerals, and detailed descriptions thereof are omitted. The descriptions regarding the heater 1*a* also apply to the heaters 1*b* to 1*f*, unless technically incompatible.

Figure 2:
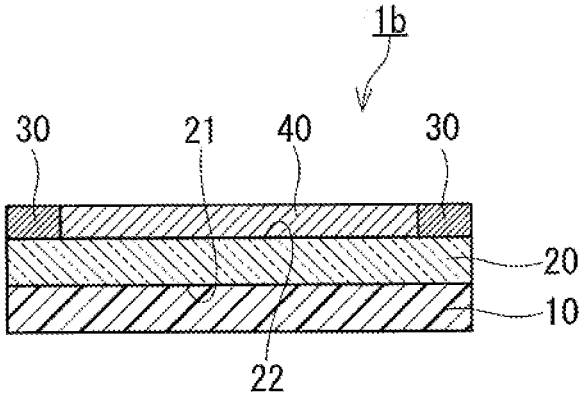
FIG. 2 is a cross-sectional view showing another example of the heater of the present invention.

As shown in FIG. 2, the heater 1*b* further includes a low refractive index layer 40. The low refractive index layer 40 may be in contact with a second principal surface 22 of a heating element 20, or may be disposed apart from the second principal surface 22.

Figure 3:
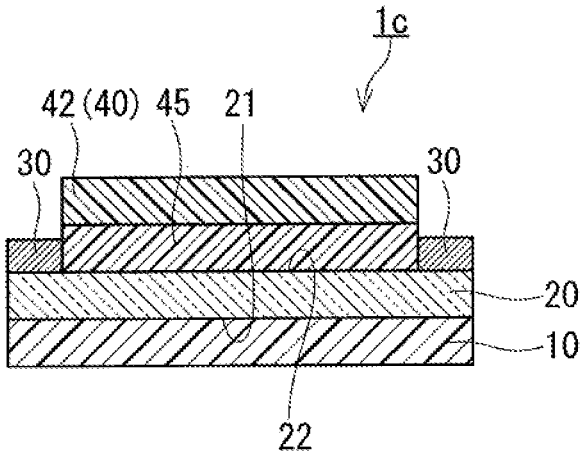
FIG. 3 is a cross-sectional view showing still another example of the heater of the present invention.

As shown in FIG. 3, the heater 1*c* further includes a protective film 42 and a first adhesive layer 45. The protective film 42 is disposed closer to a second principal surface 22 of a heating element 20 than to a first principal surface 21 of the heating element 20. The first adhesive layer 45 is located between the protective film 42 and the heating element 20 in such a manner that it is in contact with the protective film 42 and the heating element 20. The protective film 42 is an outermost layer on the side closer to the second principal surface 22 than to the first principal surface 21 of the heating element 20, and corresponds to the low refractive index layer 40. Thus, the protective film 42 is bonded to the second principal surface 22 of the heating element 20 by the first adhesive film 45. Since the heating element 20 is made of a polycrystalline material containing indium oxide as a main component as described above, the toughness thereof is generally low. On this account, by protecting the heating element 20 with the protective film 42, the impact resistance of the heater 1*c* can be unproved.

The material of the protective film 42 is not particularly limited, and may be a predetermined synthetic resin. The thickness of the protective film 42 is not particularly limited, and is, for example, 20 μm to 200 μm. With this configuration, the heater 1*c* can be prevented from having an excessively large thickness while maintaining favorable impact resistance.

The first adhesive layer 45 is not particularly limited, and is formed of a known optical pressure-sensitive adhesive such as an acrylic pressure-sensitive adhesive, for example.

Figure 4:
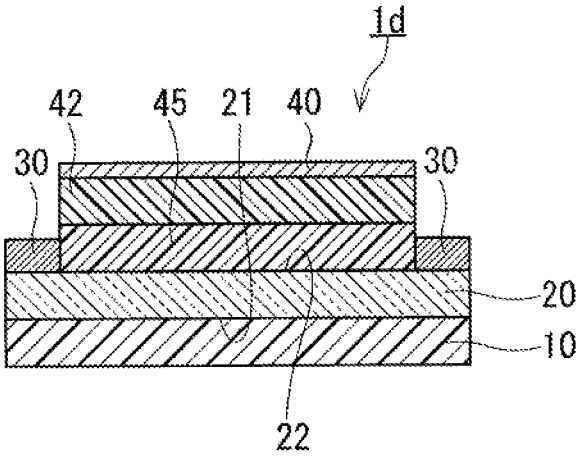
FIG. 4 is a cross-sectional view showing a modification of the heater shown in FIG. 3.

The heater 1*d* is a heater obtained by further modifying the heater 1*c*, and unless otherwise stated, the configuration thereof is the same as the configuration of the heater 1*c*. As shown in FIG. 4, the heater 1*d* further includes a protective film 42 and a first adhesive layer 45. The protective film 42 is disposed closer to a second principal surface 22 of a heating element 20 than to a first principal surface 21 of the heating element 20. The first adhesive layer 45 is located between the protective film 42 and the heating element 20 in such a manner that it is in contact with the protective film 42 and the heating element 20. As shown in FIG. 4, the heater 1*d* also has a low refractive index layer 40. The low refractive index layer 40 is formed on a principal surface of the protective film 42 on the side opposite to a principal surface of the protective film 42 in contact with the first adhesive layer 45.

According to the heater 1*d*, even when the protective film 42 has a relatively high refractive index, the heater 1*d* can exhibit a low reflectance to near-infrared light having a wavelength from 780 to 1500 nm. It is desirable that the low refractive index layer 40 have a lower refractive index than the protective film 42.

Figure 5:
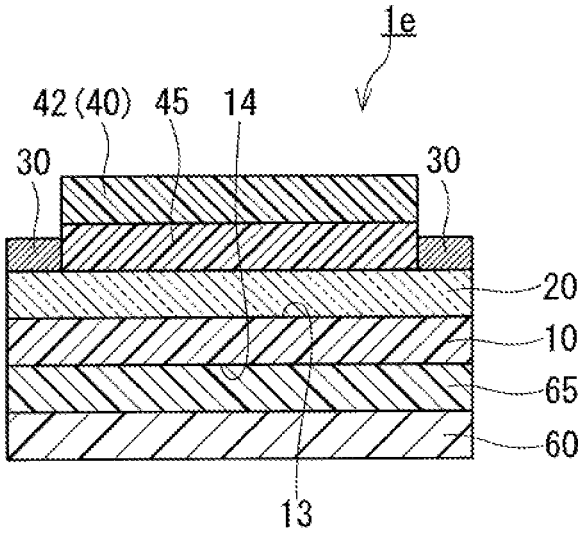
FIG. 5 is a cross-sectional view showing still another example of the heater of the present invention.

The heater 1*e* is a heater obtained by further modifying the heater 1*c*, and unless otherwise stated, the configuration thereof is the same as the configuration of the heater 1*c*. As shown in FIG. 5, the heater 1*e* further includes a separator 60 and a second adhesive layer 65. The separator 60 is disposed closer to a fourth principal surface 14 than to a third principal surface 13. The third principal surface 13 is a principal surface of a support 10 with which a heating element 20 is in contact. The fourth principal surface 14 is a principal surface of the support 10 located on the side opposite to the third principal surface 13. The second adhesive layer 65 is located between the separator 60 and the support 10 in such a manner that it is in contact with the separator 60 and the support 10. By peeling off the separator 60, the second adhesive layer 65 is exposed. Thereafter, by pressing the second adhesive layer 65 against an object to which the heater 1*e* is to be bonded, the heater 1*e* from which the separator 60 has been removed can be bonded to the object. The heaters 1*a*, 1*b* and 1*d* may also be modified in the same manner.

The separator 60 is typically a film that keeps the adhesive force of the second adhesive layer 65 when it covers the second adhesive layer 65 and can be easily peeled off from the second adhesive layer 65. The separator 60 is, for example, a film made of a polyester resin such as polyethylene terephthalate (PET).

The second adhesive layer 65 is formed of a known optical pressure-sensitive adhesive such as an acrylic pressure-sensitive adhesive, for example.

Figure 6:
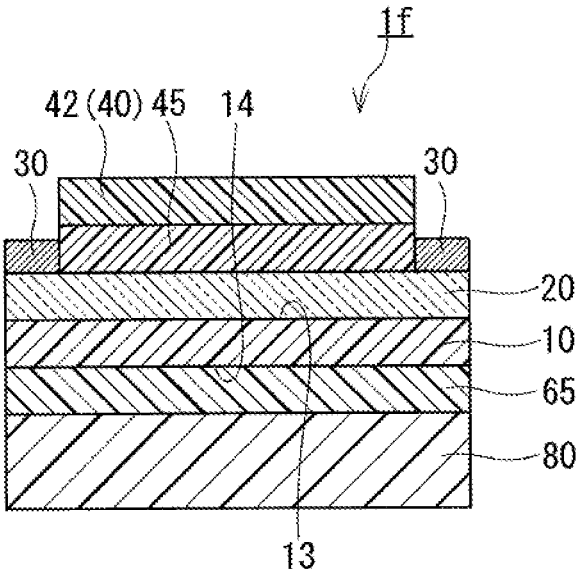
FIG. 6 is a cross-sectional view showing still another example of the heater of the present invention.

The heater 1*f* is a heater obtained by further modifying the heater 1*c*, and unless otherwise stated, the configuration thereof is the same as the configuration of the heater 1*c*. As shown in FIG. 6, the heater 1*f* further includes a molded body 80 and a second adhesive layer 65. The molded body 80 is disposed closer to a fourth principal surface 14 than to a third principal surface 13. The third principal surface 13 is a principal surface of a support 10 with which a heating element 20 is in contact. The fourth principal surface 14 is a principal surface of the support 10 located on the side opposite to the third principal surface 13. The second adhesive layer 65 is located between the molded body 80 and the support 10 in such a manner that it is in contact with the molded body 80 and the support 10. The heaters 1*a*, 1*b*, and 1*d* may also be modified in the same manner.

The molded body 80 is, for example, a component that transmits light having a wavelength of 780 to 1500 nm. For example, when substances such as mist, frost, and snow are adhering to the surface of the molded body 80, near-infrared light that should be transmitted through the molded body 80 is blocked. However, by applying a voltage to the pair of power supply electrodes 30 of the heater 1*f* to cause the heating element 20 to generate heat, the substances such as mist, frost, and snow on the surface of the molded body 80 can be removed. With this configuration, the heater 1*f* can maintain its properties to transmit the near-infrared light having a wavelength of 780 to 1500 nm.

The second adhesive layer 65 is not particularly limited, and is formed of a known optical pressure-sensitive adhesive such as an acrylic pressure-sensitive adhesive, for example.

The heater 1*f* can be produced by, for example, pressing the second adhesive layer 65 exposed after peeling off the separator 60 of the heater 1*e* against the molded body 80 to bond the heater 1*e* from which the separator 60 has been removed to the molded body 80.

EXAMPLES

Hereinafter, the present invention will be described in more detail with reference to examples. The present invention is not limited to the following examples. First, evaluation methods and measurement methods used in the examples and comparative examples will be described.

[Thickness Measurement]

The thickness of a transparent conductive film (heating element) of a heater according to each of the examples and comparative examples was measured by X-ray reflectometry using an X-ray diffractometer (Rigaku Corporation, product name: RINT 2200). The results are shown in Table 1. Also, the X-ray diffraction pattern of the transparent conductive film was obtained using the X-ray diffractometer. The X-rays used in the measurement were Cu-Kα X-rays. From the X-ray diffraction patterns obtained, whether the transparent conductive film was in a polycrystalline state or an amorphous state was determined. Also, the thickness of each power supply electrode of the heater according to each of the examples and comparative examples was measured by measuring the height of an end portion of the power supply electrode of the heater according to each of the examples and comparative examples using a stylus surface profiler (ULVAC, Inc., product name: Dektak 8). The power supply electrodes of the heater according to each of the examples and comparative examples had a thickness of 20 μm.

[Sheet Resistance and Specific Resistance]

The sheet resistance of the transparent conductive film (heating element) of the heater according to each of the examples and comparative examples was measured in accordance with the Japanese Industrial Standard (JIS) Z 2316-2014 by an eddy current method using a non-contact type resistance measurement instrument (Napson Corporation, product name: NC-80MAP). The results are shown in Table 1. In addition, the specific resistance of the transparent conductive film (heating element) of the heater according to each of the examples and comparative examples was determined by calculating the product of the thickness of the transparent conductive film (heating element) obtained by the thickness measurement and the sheet resistance of the transparent conductive film (heating element). The results are shown in Table 1.

[Carrier Density]

Using a Hall effect measurement system (Nanometrics Incorporated, product name: HL5500PC), a film with the transparent conductive film (hereinafter referred to as "transparent conductive film-coated film") according to each of the examples and comparative examples was subjected to Hall effect measurement according to the van der Pauw method. From the results of the Hall effect measurement, the carrier density of the transparent conductive film (heating element) of the heater according to each of the examples and comparative examples was determined The results are shown in Table 1.

[Crystal Grain Size]

Observation samples were prepared from the transparent conductive film-coated films according to the respective examples and some of the comparative examples. The observation sample according to each of the examples and some comparative examples was observed using a transmission electron microscope (Hitachi High-Technologies Corporation, product name: H-7650) to obtain an image with well-defined crystal grains. In the thus-obtained image, for at least 100 crystal grains, the diameter of a perfect circle having the area equal to the projected area of each crystal grain was determined as the sire of each crystal grain. Then, the average size of the at least 100 crystal grains was calculated. The results are shown in Table 1.

[Concentration of Argon Atoms]

Samples prepared from the transparent conductive film-coated films according to the respective examples and some of the comparative examples were subjected to Rutherford backscattering spectroscopy (RBS) using an ion beam analysis system (National Electrostics Corporation, product name: Pelletron 3SDH). From the results of this measurement, the concentration of argon atoms on a mass basis in each transparent conductive film was determined. The results are shown in Table 1.

[Internal Stress]

Using the X-ray diffractometer (Rigaku Corporation, product name: RINT 2200), a sample was irradiated with Cu-Kα X-rays (wavelength λ: 0.1541 nm) that had been emitted from a light source of 40 kV and 40 mA and had been transmitted through a parallel beam optical system. Then, the internal stress (compressive stress) of the transparent conductive film in the respective examples and some of the comparative examples was evaluated using the principle of the $\sin^2\psi$ method. The $\sin^2\psi$ method is a method for determining the internal stress of polycrystalline thin films from the dependence of crystal lattice strain on angles (ψ). Using the above-described X-ray diffractometer, diffraction intensities were measured at intervals of 0.02° in the range from 2θ=29.8° to 31.2° by θ/2θ scan measurement. The integration time at each measurement point was set to 100 seconds. The peak angle 2θ of the obtained X-ray diffraction (the peak of the (222) plane of ITO) and the wavelength λ of the X-rays emitted from the light source were used to calculate the ITO crystal lattice spacing d at each measurement angle (ψ). Then, the crystal lattice strain ε was calculated from the crystal lattice spacing d using the relationships of the following equations (1) and (2). λ is the wavelength of the X-rays (Cu-Kα X-rays) emitted from the light source, and λ=0.1541 nm. $d_0$ is a lattice spacing of ITO in an unstressed state, and $d_0$=0.2910 nm. The value of $d_0$ is the value obtained from the database of the International Center for Diffraction Data (ICDD).

$$2d \sin \theta = \lambda \quad (1)$$

$$\varepsilon = (d - d_0)/d_0 \quad (2)$$

Figure 7:
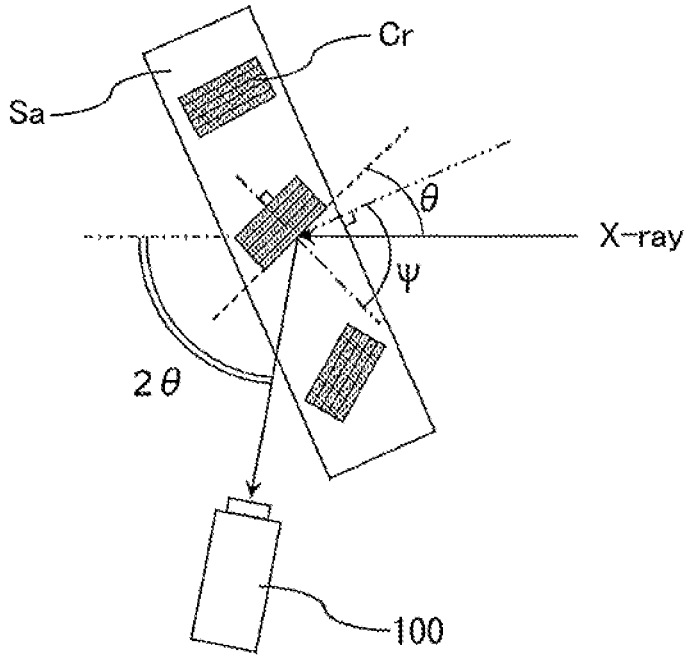
FIG. 7 is a diagram conceptually illustrating a method for measuring the internal stress of a transparent conductive film.

As shown in FIG. 7, the X-ray diffraction measurement was carried out for each of the cases where the angle (ψ) formed bet ween the normal to a principal surface of a sample Sa of the transparent conductive film and the normal to a crystal plane of the ITO crystal Cr was 45°, 52°, 60°, 70°, and 90°, and the crystal lattice strain ε at each angle (ψ) was calculated. Thereafter, the residual stress (internal stress) σ of the transparent conductive film in the in-plane direction was determined as per the following formula (3) using the slope of the straight line obtained by plotting the relationship between $\sin^2\psi$ and the crystal lattice strain ε. The results are shown in Table 1.

$$\varepsilon = \{(1+\nu)/E\}\sigma \sin^2\psi - (2\nu/E)\sigma \quad (3)$$

In the above formula (3), E is the Young's modulus (116 GPa) of ITO, and v is the Poisson's ratio (0.35). These values are described in D. G. Neerinck and T. J. Vink, "Depth Profiling of thin ITO films by grazing incidence X-ray diffraction", Thin Solid Films, 278 (1996), pp. 12-17. In FIG. 7, a detector 100 detects X-ray diffraction.

[Wrap-Around Test]

The transparent conductive film-coated film according to each of the examples and comparative examples was cut into strip shapes of 20 mm×100 mm to prepare test pieces. These test pieces were wrapped around cylindrical rods with different diameters, respectively. In this state, 100 g weights were fixed to both ends of each test piece, and the weights were suspended for 10 seconds. The transparent conductive film-coated film was wrapped around each cylindrical rod in such a manner that a support was located closer to the cylindrical rod than the transparent conductive film (heating element). Thereafter, whether the transparent conductive film had cracked was examined using an optical microscope. For the transparent conductive film-coated film according to each of the examples and comparative examples, the maximum value among the diameters of the cylindrical rods around which the transparent conductive film-coated films having the transparent conductive films with cracks were wrapped was specified. The results are shown in Table 2.

[Abrasion Test]

The transparent conductive film-coated film according to each of the examples and comparative examples was cut into a strip shape of 50 mm×150 mm, and a surface of the support in the transparent conductive film-coated film on the side opposite to a surface on which the transparent conductive film was formed was bonded to a 1.5 mm thick glass plate by a 25 μm thick pressure-sensitive adhesive layer. In this manner, a sample to be subjected to an abrasion test was prepared. Using a 10-barrel pen tester, a 100 mm-length range on an exposed surface of the transparent conductive film fixed on the glass plate was rubbed with a steel wool (product name: BON STAR, grade: #0000) by moving the steel wool back and forth 10 times while applying a load of 1 kg. Further, the environment in which the sample after being rubbed was placed was kept at 85° C. and 85% RH for 100 hours, and whether the transparent conductive film changed in color w as examined by visual observation. The results are shown in Table 2.

[Temperature Rise Characteristics]

Using a constant voltage DC power supply manufactured by Kikusui Electronics Corp., an energization test was performed by applying a voltage of 12 V to the pair of power supply electrodes of the heater according to each of the examples and comparative examples to cause a current to flow through the transparent conductive film (heating element) of the heater. During the energization test, the surface temperature of the transparent conductive film (heating element) was measured using a thermograph manufactured by FLIR Systems, Inc., and the temperature rise rate was calculated. The temperature rise characteristics of the heater according to each of the examples and comparative examples were evaluated on the basis of the temperature rise rate according to the following criteria. The results are shown in Table 2.

AA: The temperature rise rate is 100° C./min or more.

A: The temperature rise rate is 30° C./min or more and less than 100° C./min.

X: The temperature rise rate is less than 30° C./min.

Example 1

An ITO film with a thickness of 50 nm was formed on one principal surface of a polyethylene terephthalate (PET) film with a thickness of 125 μm by DC magnetron sputtering using indium tin oxide (ITO) (tin oxido content: 10 wt %) as a target material in a high magnetic field with the magnetic flux density of the horizontal magnetic field on the surface of the target material being 100 mT (millitesla) and in the presence of a trace amount of argon gas. The PET film with the ITO film formed thereon was annealed by being placed in the air at 150° C. for 3 hours. As a result, ITO was crystallized, whereby a transparent conductive film (heating element) was formed. In the above-described manner, a transparent conductive film-coated film according to Example 1 was obtained.

The transparent conductive film-coated film was cut into a strip shape (short side: 30 mm×long side: 50 mm), and the transparent conductive film was partially covered with a masking film such that a pair of end portions of the transparent conductive film facing each other and extending in the longitudinal direction were exposed. The pair of end portions each had a width of 2 mm. In this state, a Cu thin film with a thickness of 100 nm was formed on the transparent conductive film and the masking film by DC magnetron sputtering. Further, the Cu thin film was subjected to wet plating to increase the thickness of the Cu film to 20 μm. Thereafter, the masking film was removed, whereby a pair of power supply electrodes were formed at portions corresponding to the pair of end portions of the transparent conductive film. Further, a PET film with a thickness of 50 μm was bonded with a pressure-sensitive adhesive to a portion between the pair of power supply electrodes on a principal surface of the transparent conductive film on the side opposite to the principal surface of the transparent conductive film in contact with the PET film to protect the conductive film. In the above-described manner, a heater according to Example 1 was produced.

Example 2

A transparent conductive film-coated film according to Example 2 was obtained in the same manner as in Example 1, except that the conditions for the DC magnetron sputtering were changed such that a transparent conductive film had a thickness of 25 nm. A heater according to Example 2 was produced in the same manner as in Example 1, except that the transparent conductive film-coated film according to Example 2 was used instead of the transparent conductive film-coated film according to Example 1.

Example 3

A transparent conductive film-coated film according to Example 3 was obtained in the same manner as in Example 1, except that the conditions for the DC magnetron sputtering were changed such that a transparent conductive film had a thickness of 80 nm. A heater according to Example 3 was produced in the same manner as in Example 1, except that the transparent conductive film-coated film according to Example 3 was used instead of the transparent conductive film-coated film according to Example 1.

Example 4

A transparent conductive film-coated film according to Example 4 was obtained in the same manner as in Example 1, except that indium tin oxide (ITO) (tin oxide content: 5 wt %) was used as the target material. A heater according to Example 4 was produced in the same manner as in Example 1, except that the transparent conductive film-coated film according to Example 1 was used instead of the transparent conductive film-coated film according to Example 1.

Example 5

A transparent conductive film-coated film according to Example 5 was obtained in the same manner as in Example 1, except that indium tin oxide (ITO) (tin oxide content: 15 wt %) was used as the target material and that the conditions for the DC magnetron sputtering were changed such that a transparent conductive film had a thickness of 50 nm. A heater according to Example 5 was produced in the same manner as in Example 1, except that the transparent conductive film-coated film according to Example 6 was used instead of the transparent conductive film-coated film according to Example 1.

Example 6

A transparent conductive film-coated film according to Example 6 was obtained in the same manner as in Example 1, except that a polyethylene naphthalate (PEN) film with a thickness of 125 μm was used instead of the PET film. A heater according to Example 6 was produced in the same manner as in Example 1, except that the transparent conductive film-coated film according to Example 6 was used instead of the transparent conductive film-coated film according to Example 1.

Example 7

A transparent conductive film-coated film according to Example 7 was obtained in the same manner as in Example 1, except that a transparent polyimide (PI) film with a thickness of 125 μm was used instead of the PET film. A heater according to Example 7 was produced in the same manner as in Example 1, except that the transparent conductive film-coated film according to Example 7 was used instead of the transparent conductive film-coated film according to Example 1.

Comparative Example 1

A transparent conductive film-coated film according to Comparative Example 1 was obtained in the same manner as in Example 1, except that an ITO film was not annealed A heater according to Comparative Example 1 was produced in the same manner as in Example 1, except that the transparent conductive film-coated film according to Comparative Example 1 was used instead of the transparent conductive film-coated film according to Example 1.

Comparative Example 2

A transparent conductive film-coated film according to Comparative Example 2 was obtained in the same manner as in Example 1, except that the conditions for the DC magnetron sputtering were changed such that a transparent conductive film had a thickness of 17 nm. A heater according to Comparative Example 2 was produced in the same manner as in Example 1, except that the transparent conductive film-coated film according to Comparative Example 2 was used instead of the transparent conductive film-coated film according to Example 1.

Comparative Example 3

A transparent conductive film-coated film according to Comparative Example 3 was obtained in the same manner as in Example 1, except that the conditions for the DC magnetron sputtering were changed such that a transparent conductive film had a thickness of 140 nm. A heater according to Comparative Example 3 was produced in the same manner as in Example 1, except that the transparent conductive film-coated film according to Comparative Example 3 was used instead of the transparent conductive film-coated film according to Example 1.

Comparative Example 4

A transparent conductive film-coated film according to Comparative Example 4 was obtained in the same manner as in Example 1, except that the magnetic flux density of the horizontal magnetic field in the DC magnetron sputtering was changed to 30 mT such that the concentration of argon atoms in a transparent conductive film was 4.6 ppm on a mass basis. A heater according to Comparative Example 4 was produced in the same manner as in Example 1, except that the transparent conductive film-coated film according to Comparative Example 4 was used instead of the transparent conductive film-coated film according to Example 1.

Comparative Example 5

An IO film with a thickness of 40 nm was formed on one principal surface of a polyethylene terephthalate (PET) film by DC magnetron sputtering using indium oxide (IO) as a target material. Next, an Ag film with a thickness of 13 nm was formed on the IO film by DC magnetron guttering using silver (Ag) as a target material. Next, an IO film with a thickness of 40 nm was formed on the Ag film by DC magnetron sputtering using indium oxide (IO) as a target material. In the above-described manner, a transparent conductive film-coated film according to Example 5 was obtained. A heater according to Comparative Example 5 was produced in the same manner as in Example 1, except that the transparent conductive film-coated film according to Comparative Example 5 was used instead of the transparent conductive film-coated film according to Example 1.

Comparative Example 6

Indium tin oxide (ITO) (tin oxide content: 5 wt %) was used as a target material. A transparent conductive film-coated film according to Comparative Example 6 was obtained in the same manner as in Example 1, except that, in addition to the above, the magnetic flux density of the horizontal magnetic field in the DC magnetron sputtering was changed to 30 mT such that a transparent conductive film had a thickness of 400 nm and also the concentration of argon atoms in the transparent conductive film was 5.2 ppm on a mass basis. A heater according to Comparative Example 6 was produced in the same manner as in Example 1, except that the transparent conductive film-coated film according to Comparative Example 6 was used instead of the transparent conductive film-coated film according to Example 1.

According to the results of the wrap-around test shown in Table 2, in Comparative Examples 3 and 6, the maximum values among the diameters of the cylindrical rods around which the heaters having the transparent conductive films with cracks were wrapped were as large as 32 mm and 28 mm, respectively. In contrast, in Examples 1 to 7, the maximum values among the diameters of the cylindrical rods around which the heaters having the transparent conductive films with cracks were wrapped were as small as 12 to 18 mm. These results suggest that the transparent conductive films of the heaters according to Examples 1 to 7 were highly resistant to bending.

According to the results of the abrasion test shown in Table 2, while change in color of the transparent conductive film was observed in Comparative Example 5, change in color of the transparent conductive films was not observed in Examples 1 to 7. These results suggest that the transparent conductive films of the heaters according to Examples 1 to 7 were highly resistant to abrasion.

According to the results of the evaluation of the temperature rise characteristics shown in Table 2, while the heaters of Comparative Examples 1, 2, and 4 exhibited low temperature rise rates, the heaters of Examples 1 to 7 exhibited high temperature rise rates.

TABLE 1

| | Transparent conductive film (heating element) | | | | | | | | | | Support | |
|---|---|---|---|---|---|---|---|---|---|---|---|---|
| | Material | (1) | Film structure | Thickness [nm] | Sheet resistance [Ω/sq] | Specific resistance [$\times 10^{-4}$ Ω · cm] | Carrier density [$\times 10^{20}$ $cm^3$] | Average size of crystal grains [nm] | Argon atom concentration on mass basis [ppm] | Internal stress [MPa] | Material | Thickness [μm] |
| Ex. 1 | ITO $SnO_2$ 10 wt % | 0.093 | polycrystalline | 50 | 40 | 2.0 | 12 | 210 | 2.5 | 582 | PET | 125 |
| Ex. 2 | ITO $SnO_2$ 10 wt % | 0.093 | polycrystalline | 25 | 83 | 2.1 | 12 | 230 | 2.6 | 530 | PET | 125 |
| Ex. 3 | ITO $SnO_2$ 10 wt % | 0.093 | polycrystalline | 80 | 24 | 1.9 | 12 | 180 | 2.7 | 618 | PET | 125 |
| Ex. 4 | ITO $SnO_2$ 5 wt % | 0.046 | polycrystalline | 50 | 52 | 2.6 | 8.2 | 200 | 2.5 | 565 | PET | 125 |
| Ex. 5 | ITO $SnO_2$ 15 wt % | 0.140 | polycrystalline | 50 | 40 | 2.3 | 13 | 220 | 2.5 | 603 | PET | 123 |
| Ex. 6 | ITO $SnO_2$ 10 wt % | 0.093 | polycrystalline | 50 | 39 | 2.0 | 12 | 210 | 2.5 | 235 | PET | 125 |
| Ex. 7 | ITO $SnO_2$ 10 wt % | 0.093 | polycrystalline | 50 | 40 | 2.0 | 12 | 210 | 2.6 | 183 | transparent PI | 125 |
| Comp. Ex. 1 | ITO $SnO_2$ 10 wt % | 0.093 | amorphous | 50 | 143 | 7.2 | 4.3 | — | 2.5 | — | PET | 125 |

TABLE 1-continued

| | Transparent conductive film (heating element) | | | | | | | | | | | |
|---|---|---|---|---|---|---|---|---|---|---|---|---|
| | Material | (1) | Film structure | Thickness [nm] | Sheet resistance [Ω/sq] | Specific resistance [$\times 10^{-4}$ Ω · cm] | Carrier density [$\times 10^{20}$ $cm^3$] | Average size of crystal grains [nm] | Argon atom concentration on mass basis [ppm] | Internal stress [MPa] | Support Material | Support Thickness [μm] |
| Comp. Ex. 2 | ITO $SnO_2$ 10 wt % | 0.093 | polycrystalline | 17 | 135 | 2.3 | 12 | 230 | 2.4 | 453 | PET | 125 |
| Comp. Ex. 3 | ITO $SnO_2$ 10 wt % | 0.093 | polycrystalline | 140 | 15 | 2.1 | 12 | 130 | 2.7 | 658 | PET | 125 |
| Comp. Ex. 4 | ITO $SnO_2$ 10 wt % | 0.093 | polycrystalline | 50 | 110 | 5.5 | 5.3 | 110 | 4.6 | 758 | PET | 125 |
| Comp. Ex. 5 | IO/Ag/IO | — | — | 40/13/40 | 12 | — | — | — | — | — | PET | — |
| Comp. Ex. 6 | ITO $SnO_2$ 5 wt % | 0.046 | amorphous | 400 | 22 | 8.8 | 4.7 | 90 | 5.2 | 825 | PET | 125 |

(1) Ratio of the number of Sn atoms to sum of the number of In atoms and the number of Sa atoms in heating element

TABLE 2

| | Wrap-around test Maximum diameter of cylindrical rods when cracking occurred [mm] | Whether change in color was observed after abrasion test | Temperature rise characteristics |
|---|---|---|---|
| Example 1 | 14 | No | A |
| Example 2 | 12 | No | A |
| Example 3 | 18 | No | AA |
| Example 4 | 14 | No | A |
| Example 5 | 14 | No | A |
| Example 6 | 18 | No | A |
| Example 7 | 18 | No | A |
| Comparative Example 1 | 12 | No | X |
| Comparative Example 2 | 12 | No | X |
| Comparative Example 3 | 28 | No | AA |
| Comparative Example 4 | 14 | No | X |
| Comparative Example 5 | 14 | Yes | AA |
| Comparative Example 6 | 32 | No | AA |

The invention claimed is:

1. A heater comprising:

a support that is made of an organic polymer and has a sheet shape;

a heating element that is a transparent conductive film made of a polycrystalline material containing indium oxide as a main component; and at least one pair of power supply electrodes in contact with the heating element, wherein the heating element has a thickness of more than 20 nm and not more than 100 nm, the heating element has a specific resistance of $1.4\times10^{-4}$ Ω·cm to $3\times10^{-4}$ Ω·cm, and the heating element comprises argons, a concentration of argon atoms contained in the heating element is 3.5 ppm to 2.5 ppm on a mass basis.

2. The heater according to claim 1, wherein the heating element has a carrier density of $6\times10^{20}$ $cm^{-3}$ to $16\times10^{20}$ $cm^{-3}$.

3. The heater according to claim 1, wherein the heating element further comprises tin, a ratio of a number of tin atoms to a sum of a number of indium atoms and the number of the tin atoms in the heating element is 0.04 to 0.15.

4. The heater according to claim 1, wherein crystal grains of the heating element have an average size of 150 nm to 500 nm.

5. The heater according to claim 1, wherein an internal stress of the heating element as measured by an X-ray stress measurement method is 20 to 650 MPa.

6. The heater according to claim 1, wherein the power supply electrodes have a thickness of 1 μm or more.

7. The heater according to claim 1, wherein the support is made of at least one selected from the group consisting of polyethylene terephthalates, polyethylene naphthalates, polyimides, polycarbonates, polyolefins, polyether ether ketones, and aromatic polyamides.

8. The heater according to claim 1, further comprising:

a protective film that is disposed closer to a second principal surface than to a first principal surface, the first principal surface being a principal surface of the heating element in contact with the support and the second principal surface being a principal surface of the heating element located on a side opposite to the first principal surface; and a first adhesive layer that is disposed between the protective film and the heating element in such a manner that the first adhesive layer is in contact with the protective film and the heating element.

9. The heater according to claim 1, further comprising:

a separator that is disposed closer to a fourth principal surface than to a third principal surface, the third principal surface being a principal surface of the support with which the heating element is in contact and the fourth principal surface being a principal surface of the support located on a side opposite to the third principal surface; and a second adhesive layer that is disposed between the separator and the support in such a manner that the second adhesive layer is in contact with the separator and the support.

10. The heater according to claim 1, further comprising:

a molded body that is disposed closer to a fourth principal surface than to a third principal surface, the third principal surface being a principal surface of the support with which the heating element is in contact and the fourth principal surface being a principal surface of the support located on a side opposite to the third principal surface; and a second adhesive layer that is disposed between the molded body and the support in such a manner that the second adhesive layer is in contact with the molded body and the support.

11. The heater according to claim 1, wherein, in an apparatus configured to execute processing using near-infrared light within a wavelength range from 780 to 1500 nm, the heater is to be disposed on an optical path of the near-infrared light.

* * * * *